United States Patent [19]

Smith

[11] 4,340,026

[45] Jul. 20, 1982

[54] WOOD BURNING STOVE

[76] Inventor: James H. Smith, R.D. #1, Rte. 23, Narvon, Pa. 17555

[21] Appl. No.: 111,732

[22] Filed: Jan. 14, 1980

Related U.S. Application Data

[62] Division of Ser. No. 762,800, Jan. 26, 1977, Pat. No. 4,204,518.

[51] Int. Cl.[3] ..... F24B 9/04

[52] U.S. Cl. ..... 126/5; 126/193

[58] Field of Search ..... 126/5, 31, 34, 77, 121, 126/122, 132, 133, 193; 237/51, 56

[56] References Cited

U.S. PATENT DOCUMENTS

| | | | |
|---|---|---|---|
| 398,862 | 3/1889 | Stott | 126/193 |
| 2,052,643 | 9/1936 | Modine | 126/121 |
| 2,743,720 | 5/1956 | Dollinger | 126/121 |
| 3,168,088 | 2/1965 | Martin et al. | 126/77 |
| 4,018,209 | 4/1977 | Bonvicini | 126/121 |
| 4,050,441 | 9/1977 | Horwinski | 126/132 X |

FOREIGN PATENT DOCUMENTS

| | | | |
|---|---|---|---|
| 836574 | 1/1939 | France | 237/56 |
| 2270532 | 12/1975 | France | 126/132 |
| 587970 | 5/1947 | United Kingdom | 126/132 |

*Primary Examiner*—Lloyd L. King
*Assistant Examiner*—Harold Joyce

[57] ABSTRACT

A wood burning heating unit having walls defining a combustion chamber, the walls having wall cavities therein for heating a liquid; baffle means within the walls dividing the wall cavities to provide directional liquid flow paths; a heat absorption unit formed of spaced tubes communicating with the wall cavities positioned above the combustion chamber; and inlet outlet water conduit means communicating with the wall cavities.

2 Claims, 8 Drawing Figures

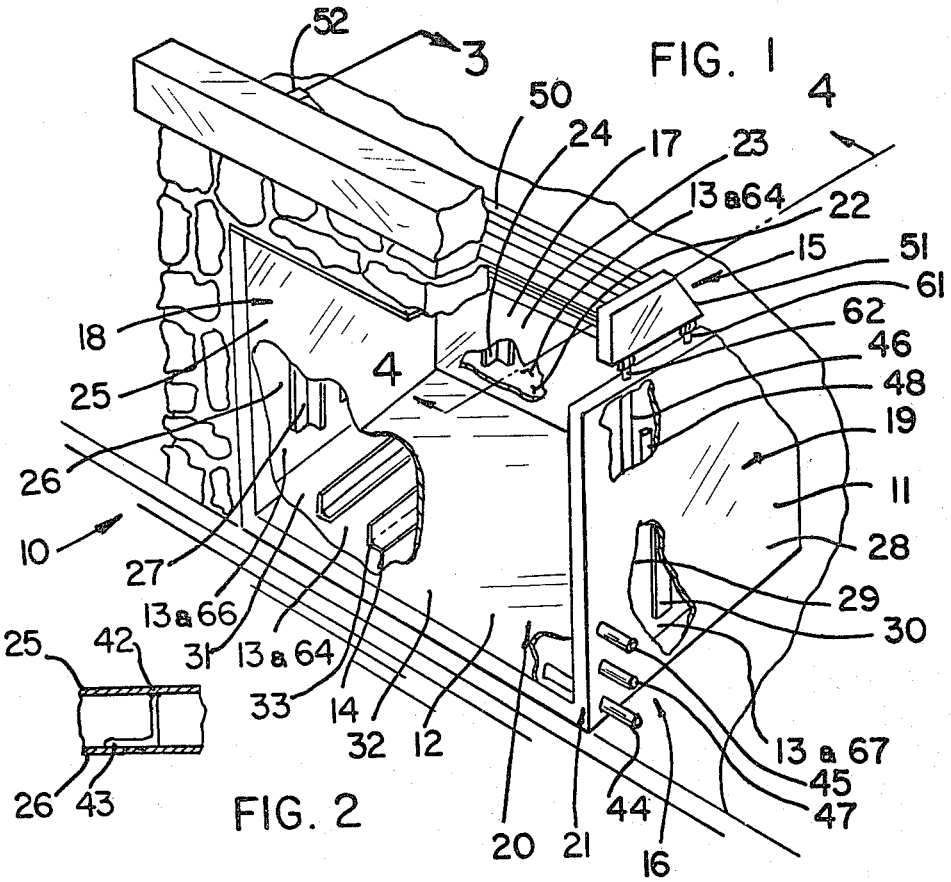
FIG. 1
FIG. 2
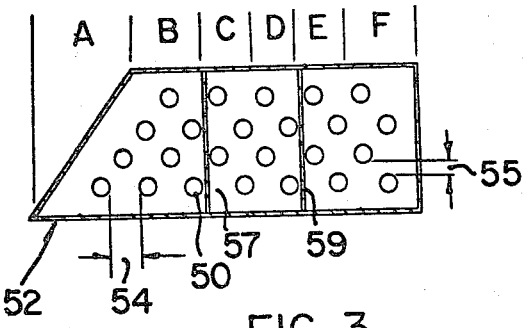
FIG. 3
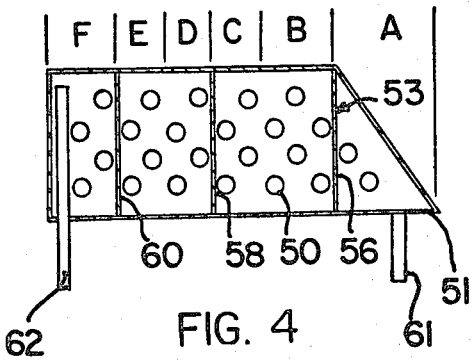
FIG. 4

WOOD BURNING STOVE

This is a division of application, Ser. No. 762,800 filed Jan. 26, 1977 now U.S. Pat. No. 4,204,518.

BACKGROUND OF THE INVENTION

The invention relates to a wood burning heating unit and particularly concerns a wood burning heating unit for reclaiming waste heat by water flow.

Fireplaces and free standing wood burning space heaters or stoves generally contain a combustion chamber in which wood or a similarly combustible material is burned to produce heat. In some prior units the heat is directly radiated into the room from the fire and/or from a heated portion of the unit. In other prior units room air is circulated by convection through ductwork within the unit to extract waste heat from the flue gases. Although some waste heat is recovered a large portion may continue to be lost and therefore not available as usable room heat. Also the collected heat is added to the already heated space adjacent to the heating unit. This permits continued existance of distance cold areas in the room as well as high temperatures in the room adjacent the heating unit.

SUMMARY OF THE INVENTION

The present invention is a wood burning heating unit having walls defining a combustion chamber, the walls having wall cavities therein for heating a liquid; baffle means within the walls dividing the wall cavities to provide directional liquid flow paths; a heat absorption unit formed of spaced tubes communicating with the wall cavities positioned above the combustion chamber; and inlet-outlet water conduit means communicating with the wall cavities. In one embodiment the heating unit also includes a floor below the combustion chamber having a floor cavity communicating with the wall cavities and baffle means within the floor cavity dividing the floor cavity to provide directional flow paths into the wall cavities.

The novel wood burning heating unit maximizes the collection of heat produced by the fire. Liquid flow within the unit collects the heat. Heat is progressively collected in liquid contained in the floor cavity, then in liquid contained in the wall cavities, and then in liquid contained in the heat absorption unit. Liquid flow transfers the heat to radiant heating units which are located in cold areas of the same room or in distant rooms. A continuous supply of the available heat directly from the unit as well as from other areas of the room provide a substantially uniform temperature within the room.

BRIEF DESCRIPTION OF THE FIGURES

FIG. 1 illustrates a partially broken away view of a wood burning firplace heating unit positioned within a fireplace.

FIG. 2 illustrates the attachment of the baffles in the fireplace heating unit of FIG. 1.

FIGS. 3 and 4 illustrate a sectional view through the left and right header respectfully of the heat absorption unit for the fireplace heating unit of FIG. 1.

DESCRIPTION OF THE PREFERRED EMBODIMENT

Figure 5:
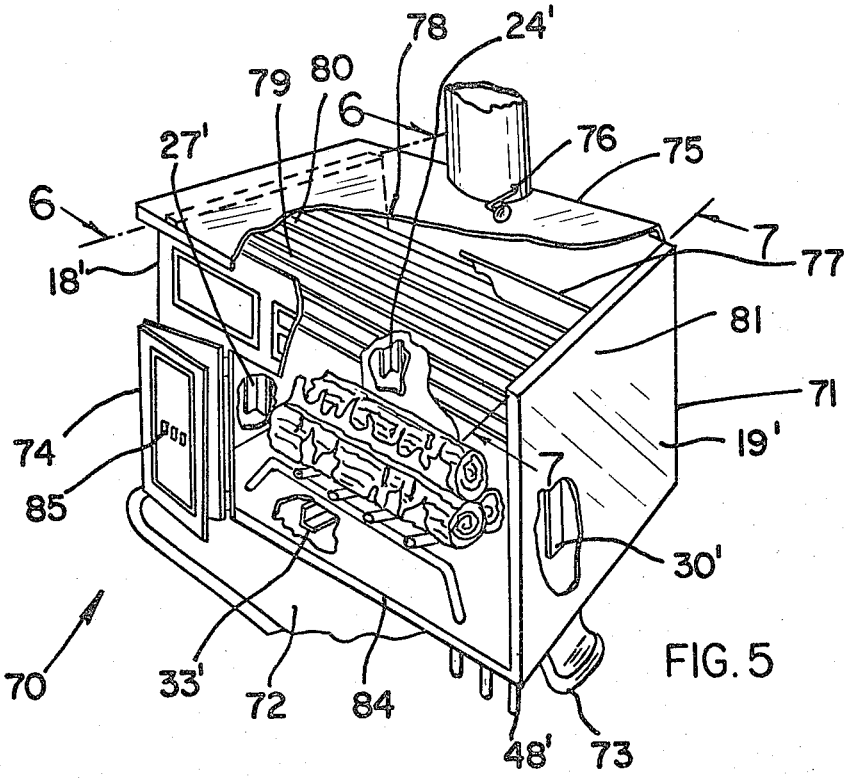
FIG. 5 illustrates a partially broken away view of an alternative embodiment of the heating unit of FIG. 1 where it is formed as a front opening free standing wood burning stove.

FIG. 1 illustrates a novel heating unit 10 formed of a size to be receivable within a fireplace opening. The heating unit 10 includes walls 11 and a floor 12 having communicating cavities 13 therein, baffles 14 spacing the walls and floor 12, a tubular heat absorption unit 15 and inlet-outlet-fill conduit means 16 communicating with the cavities 13. The walls 11 include a back wall 17, a left side wall 18 and a right side wall 19. The left side wall 18 and the right side wall 19 each diverge outward from the back wall 17 at substantially the same angle as the fireplace side walls. The combustion chamber 20 is defined by the walls 11, floor 12 and the front 21 of the fireplace opening.

The walls 11 and floor 12 are hollow to form communicating cavities 13 therein. The back wall 17 is formed of an outside back wall member 22, an inside back wall member 23 and vertical back wall baffles 24 spacing the back wall members 22 and 23. The left side wall 18 is formed of an outside left wall member 25, an inside left wall member 26 and vertical left wall baffles 27 spacing the left wall members 25 and 26. The right side wall 19 is formed of an outside right wall member 28, an inside right wall member 29 and vertical right wall baffles 30 spacing the right wall members 28 and 29. The floor 12 is formed of a lower floor member 31, an upper floor member 32 and front-to-rear floor baffles 33 spacing the floor members 31 and 32. The floor and wall members are formed from No. 1018, 12 gauge hot rolled steel.

The baffles 24 in the back wall 17 have a spacing therebetween of about 5 inches. The baffles in the left side wall 18 have a first spacing from the front edge of about $4\frac{1}{2}$ inches, a second spacing between baffles 27 of about $9\frac{1}{2}$ inches and a third spacing between baffles 27 of about $14\frac{1}{2}$ inches. The baffles 30 in the right side wall 19 have a first spacing from the front edge of about $3\frac{1}{2}$ inches, a second spacing between baffles 30 of about $8\frac{1}{2}$ inches and a third spacing of about $13\frac{1}{2}$ inches between baffles 30. The baffles in the floor 12 have a spacing therebetween of about 5 inches. The baffles 24, 27, 30 and 33 are formed of 10 gauge hot rolled steel in the shape of a 1 inch$\times$1 inch angle. All the baffles are about 3 inches shorter at each end than the floor or wall member to which they are attached.

The baffles in addition to directing liquid flow as will be described space the wall members and provide the cavities 13 within the walls 11. Therefore it is extremely important that the baffles are secured to both wall members.

Referring to FIG. 3 the baffles are secured by welding a flange edge 42 to an inner wall or upper floor member while maintaining the opposite flange outer surface 43 substantially parallel to an outer wall or lower floor member. The outer wall members and lower floor members are formed with about $\frac{1}{2}$ inch diameter holes at the positions of the flange outer surface 43. The outer wall and floor members are then secured by welding the edge of the holes to the flange outer surface 43. This provides a secure spacing of the inner and outer wall and floor members thereby preventing bulging of the cavities 13 from the weight and pressure of the liquid within the walls 11.

The inlet-outlet-fill conduit means 16 includes an inlet conduit 44, an outlet conduit 45 with a standpipe 46 and a fill conduit 47 with a standpipe 48. The inlet-outlet-fill conduit means 16 can enter the cavities 13 through the lower wall or floor either for convenience in concealing the connection or for convenience in attachment to existing or new radiation. In the preferred embodiment of FIG. 1 the entry location is at the right side wall 19. The inlet conduit 44 connects to an internal conduit within the floor cavity having an outlet projecting substantially perpendicular to the side wall and having its axis facing generally in the direction of the front edge of the floor 11. The standpipe 46 of the outlet conduit 45 is received within the wall cavity and connects to the outlet of the heat absorption unit 15 with its top or inlet opening 49 positioned about $\frac{3}{4}$ inch from the top of the heat absorption unit 15. The standpipe 48 of the fill conduit 47 also extends vertically within a wall cavity as shown in FIG. 1.

The heat absorption unit 15 illustrated in FIG. 1 is formed of a plurality of horizontal metal tubes 50. The unit 15 includes twenty-four tubes 50 each having an outside diameter of about $\frac{7}{8}$ inch. The tubes 50 terminate at each end in a right header 51 (FIG. 3) and a left header 52 (FIG. 4). The headers 51 and 52 are box like with the open interior or cavities therein communicating directly with the interior of the tubes 50. The headers 51 and 52 also have baffles 53 therein to group the tubes 50 into a continuous passageway, portions of which include a plurality of tubes 50.

For ease of description, FIG. 3 illustrates an outwardly folded view of a section through the left header 52 and FIG. 4 illustrates an outwardly folded view of a section through the right header 51. The space 54 between the tubes 50 within each row is about $\frac{5}{8}$ inch and the space 55 between the tubes 50 between each row is about $\frac{5}{8}$ inch. Alternate rows are staggered so that the tubes 50 in higher rows are positioned above the space in the lower adjacent rows. This provides for a maximum contact of the tubes 50 by the rising heat.

The right header 51 includes a first baffle 56 separating an A group of tubes 50 from a B-C group of tubes 50; the left header 52 includes a second baffle 57 separating an A-B group of tubes 50 from a C-D group of tubes 50; the right header 51 includes a third baffle 58 separating a B-C group of tubes 50 from a D-E group of tubes 50; the left header 52 includes a fourth baffle 59 separating a C-D group of tubes 50 from an E-F group of tubes 50; and the right header 51 includes a fifth baffle 60 separating a D-E group of tubes 50 from a F group of tubes 50. The header inlet conduit 61 enters the right header 51 at the front to the A group of tubes 50 and a header outlet conduit 62 enters the right header 51 at the rear to the F group of tubes 50.

The heat absorption unit 15 illustrated in FIG. 1 is a separated unit positioned above the walls 11 by connecting the conduits 61 and 62 with compression tube fittings to the top of the left side wall 18. The heat absorption unit 15 is formed as a separate detachable unit to permit installation after the walls 11 are installed in the fireplace. This permits installation of the heat absorption unit 15 behind the mantle portion of the fireplace where it is not directly visible. As illustrated in FIG. 1 the heat absorption unit 15 is positioned directly above the fire position within the combustion chamber to permit most if not all of the rising heat from the combustion process to pass directly through the heat absorption tubing and results in the extraction of about 65 percent of the waste heat therein. The majority of the heavy combustion products pass to the front of the heat absorption unit 15 thereby preventing soot deposits which may interfere with the efficiency.

In the assembly of the heating unit 10 illustrated in FIG. 1 the inner and outer wall members are formed to size, the required openings are made and they are bent to the required shape. The inner wall members and upper floor member with attached ends are assembled first. Then the baffles are attached as illustrated in FIG. 2. The inlet-outlet-fill conduits are then secured in the wall cavity in their proper position and finally the outer wall members and lower floor member are attached. All attachment or securing is by welding. Continuous welds are used at all seams to insure a water tight cavity 13.

The heat absorption unit 15 is separately assembled. First the inner header walls with attached ends are positioned with openings therein over the tubes 50 with the tubes 50 extending about $\frac{1}{8}$ inch through the matching hole in the inner header wall. The tubes 50 are then welded on their periphery at the joinder of the extended ends with the headers. Then fixtures are attached to each end of the semi-finished heat absorption unit and the unit is pressure tested. The inlet-outlet conduits are then secured and finally the outer header walls are attached. The heat absorption unit 15 is then assembled to the walls by the conduits 61 and 62.

In the operation of the novel heating unit 10 of FIG. 1 a heat absorbing liquid, preferably water, enters the heating unit 10 through the inlet conduit 45 into the floor cavity 64. The water is at a pressure of about 12–15 pounds per square inch gauge (PSIG). As previously described, the inlet conduit 45 projects water at a right angle to the right side wall 19 directly across the floor cavity 64 adjacent the front of the floor cavity 64. The water flow is then from the front of the floor cavity 64 towards the rear of the floor cavity 64, flow being directed by the front-to-rear floor baffle 33. The flow is then up the back wall cavity 65 also directed by the back wall baffles 24. The initial liquid flow absorbs heat from the combustion process at the floor 12 and at the back wall 17. This absorbed heat is believed to provide movement or circulation of the water around the periphery of the floor cavity 64 in the channels formed between the end of the baffles and the exterior periphery wall and between the floor baffles 33. The circulation of the water in the floor cavity 64 is believed to be caused by the attraction of the unheated or cooler water to the heated (hot) surface areas thereby resulting in the absorption of the heat in these areas while cooling them.

Secondary flow also generally is up the left side wall cavity 66 and right side wall cavity 67 between the vertical left wall baffles 27 and the vertical right wall baffles 30.

The heated water then flows through the heat absorption unit 15. Water enters the heat absorption unit 15 through inlet header conduit 61 into the right header 51. Water flow is then directed by the first baffle 56 through the A group of tubes 50 to the left header 52; then directed by the second baffle 57 through the B group of tubes 50 towards the right header 51; then directed by the third baffle 58 through the C group of tubes 50 towards the left header 52, then directed by the fourth baffle 59 through the D group of tubes 50 towards the right header 51; then directed by the fifth baffle 60 through the E group of tubes 50 to the left header 52; and then directed by the front wall of the left header 52 through the F group of tubes 50 to the right header 51. The water then exits the right header 51 through the header outlet 62 and into the standpipe 46 to flow out the outlet conduit 45 to the connected radiant heating units.

Although it is believed the previously described flow path is the flow path within the heating unit 10 it is also believed that some areas may exist within the cavities 13 where the water flow or circulation is a minimum or even stagnant. It is believed that such areas have a minimum or no effect on the efficient operation of the unit, particularly since no hot spots have been found to occur on the walls of the heating unit 10. It has been determined that during normal operation of the heating unit 10 at a flow rate of about 5 gallons per minute a 15 to 20 degree temperature differential is obtained between the inlet water temperature and the outlet water temperature. It is also believed that the previously described flow path results in the hottest water at the outlet of the heat absorption unit 15. Therefore this is the position where the water is withdrawn from the heating unit 10.

FIG. 5 illustrates an alternative embodiment of a heating unit 10. In FIG. 5 the heating unit 10 is formed as a free standing stove 70 having an appearance similar to the Franklin Stove. The stove 70 includes a heating unit 71 similar to the heating unit 10, a hearth plate 72, legs 73, two pair of folding front doors 74 (only one pair of which are shown in FIG. 5), a top 75 with a flue outlet including a damper 76 and internal flue means 77 between the top of the walls 11 and the flue outlet 76.

The main difference in the heating unit 71 in the stove 70 is the integral construction of a heat absorption unit 78. The heat absorption unit 78 illustrated in FIG. 5 is also formed of a plurality of horizontal tubes 79. The heat absorption unit 78 includes twenty-seven tubes 79 each having an outside diameter of about $\frac{7}{8}$ inch. The tubes 79 terminate at each end in a left header 80 (also see FIG. 7) formed integral to the left side wall 18' and in a right header 81 (also see FIG. 8) formed integral to the right side wall 19'. The left and right headers 80 and 81 are formed by baffling with the walls to group the tubes 79 into a continuous passageway, portions of which include a plurality of tubes.

Figure 6:
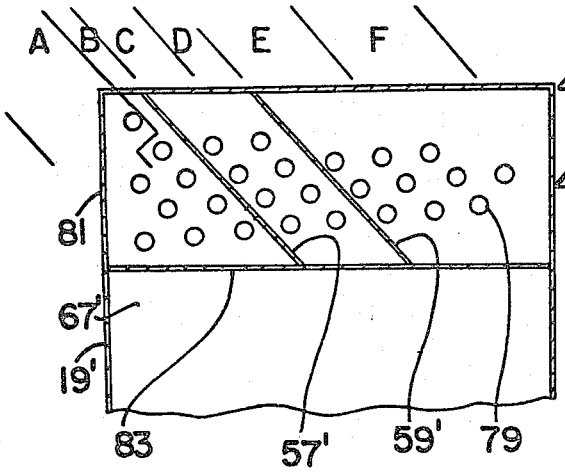
FIGS. 6 and 7 are similar to FIGS. 3 and 4 for the alternative embodiment of the heating unit illustrated in FIG. 5.
Figure 7:
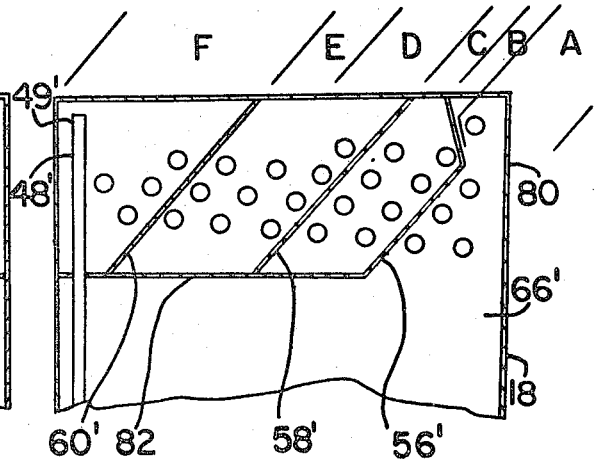

FIG. 6 (similar to FIG. 4) illustrates a sectional view through the right header 81 and FIG. 7 (similar to FIG. 3) illustrates a sectional view through the left header 80. The tubes 79 are spaced and staggered similar to the embodiment of FIG. 1.

The left header 80 is separated from the left side wall cavity 66' by a left lower divider 82 and the right header 81 is separated from the right side wall cavity 67' by a right lower divider 83. The left header 80 includes a first baffle 56' separating an A group of tubes 79 from a B-C group of tubes 79; the right header 81 includes a second baffle 57' separating an A-B group of tubes 79 from a C-D group of tubes 79; the left header 80 includes a third baffle 58' separating a B-C group of tubes 79 from a D-E group of tubes 79; the right header 81 includes a fourth baffle 59' separating a C-D group of tubes 79 from an E-F group of tubes 79; and the left header 80 includes a fifth baffle 60' separating a D-E group of tubes 79 from a F group of tubes 79. The header inlet is directly from the left wall into the A group of tubes 79 and the header outlet is directly from the F group of tubes into the top 49' of outlet standpipe 48'.

The operation of the stove 70 is believed to be the same as the operation of the heating unit 10. Although the shape of the heat absorption unit is changed to obtain the stove shape the water flow path is substantially the same.

The stove 70 utilizes both primary and secondary air to maximize burning time. The doors 73 are sealed at the upper, left and right periphery by an asbestos gasket 84. The primary air enters through a space between the stove front and the lower portion of each pair of doors at the bottom. The secondary air enters through air openings 85 in the doors. The air openings in the doors are at about the midpoint of the doors at about the position of the top of a log fire. With the use of primary and secondary air a fire can be maintained for 10 to 16 hours.

Figure 8:
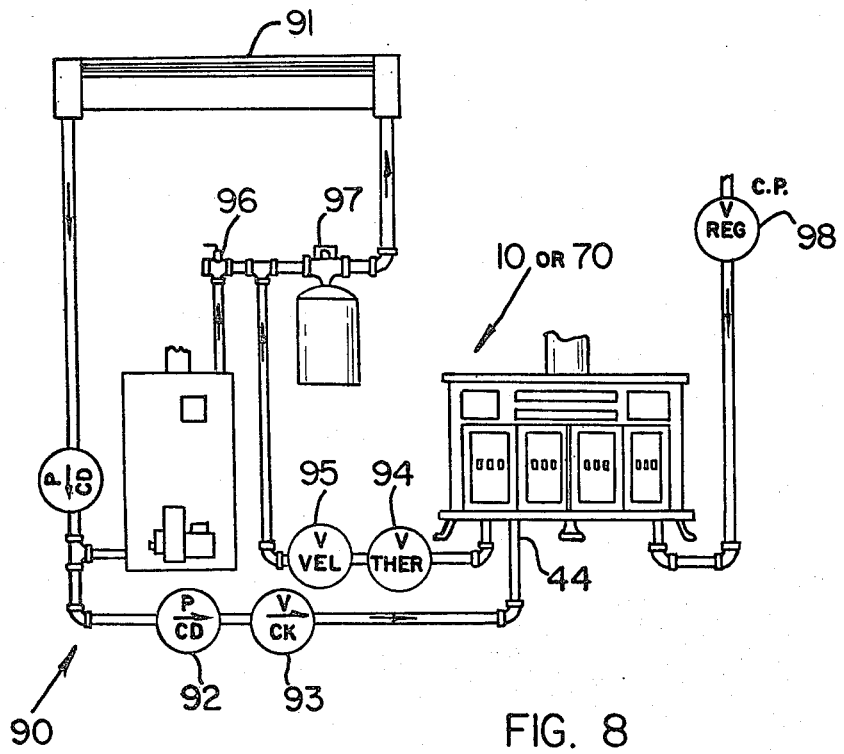
FIG. 8 illustrates the heating unit of FIG. 1 or FIG. 5 connected to radiant heating units.

FIG. 8 illustrates the connection of the heating unit 10 or stove 70 to an existing hot water heating system 90. Inlet water is withdrawn from the outlet of a radiant heating unit 91. Flow is through a circulator pump 92, a check valve 93 and into the outlet conduit 44' of the stove 70. Internal water flow within the stove 70 is as previously described for the heating unit 10. Water flow is from the stove 70 through a temperature control aquastat 94, a pressure relief valve 95 and into the existing hot water system 90. It is preferred that the outlet water be connected to the existing hot water system 90 between the flow control valve 96 and the expansion tank 97. An automatic fill valve 98 provides water to the stove 70. The stove 70 operates the circulator pump 92 to supply water at a preset temperature. The heated water flows in the radiation thereby heating extended areas of the same room or adjacent rooms. Where the stove 70 is connected to an existing hot water heating system 90 it supplements the supply of heat from the existing hot water system. The stove 70 may also be used as the sole source of heat to radiant heating units.

Although it is preferred and described that the heating unit 10 include a floor, a heating unit without a floor can be used where there is an existing floor in the fireplace. In this embodiment the water circulates within the channel formed between the end of the wall baffles and the lower edge of the walls and then rises as previously described.

I claim:

1. A wood burning heating unit having a combustion gas exit for use as a stove for space heating comprising:

(a) a left side wall, a back side wall and a right side wall defining a combustion chamber, said walls having wall cavities therein for heating a liquid;

(b) a floor (c) spaced baffle members extending vertically within said walls and shorter in length than said walls to divide said wall cavities to provide vertical directional liquid flow paths;

(d) a plurality of rows of spaced alternating horizontal tubes forming a maze with alternating tubes and spaces in each row positioned above said combustion chamber, a group of said tubes providing a parallel path connected in series to a second group of said tubes providing a parallel path positioned between said left side wall and said right side wall (e) baffle means within said walls to provide said series continuous flow path through said groups of tubes having said parallel paths; and (f) inlet and outlet liquid conduit means communicating with said wall cavities.

2. The heating unit defined in claim 10 additionally comprising:

(a) means for closing the front opening into said heating unit, (b) means for admitting primary air at about the lower portion of said front opening, and (c) means for admitting secondary air at about the midpoint of said means for closing the front opening into said heating unit.

* * * * *